United States Patent [19]

Frahm et al.

[11] 4,143,784

[45] Mar. 13, 1979

[54] WATER BOTTLE AND ITS STORAGE CASE

[76] Inventors: Carl E. Frahm; Shirley E. Frahm, both of 1428 Oak Meadow Rd., Arcadia, Calif. 91006

[21] Appl. No.: 813,506

[22] Filed: Jul. 7, 1977

Related U.S. Application Data

[63] Continuation of Ser. No. 605,462, Aug. 18, 1975, abandoned.

[51] Int. Cl.[2] ..... B65D 11/16

[52] U.S. Cl. ..... 215/12 R; 215/1 R; 220/72

[58] Field of Search ..... 215/12 R, 1 R; 217/52, 217/53, 54; 220/72

[56] References Cited

U.S. PATENT DOCUMENTS

| | | | |
|---|---|---|---|
| D. 21,612 | 6/1892 | Underhill | 215/R |
| 59,159 | 10/1866 | Atterbury | 215/1 R |
| 184,593 | 11/1876 | Curtice | 215/1 R |
| 197,595 | 11/1877 | Brown | 215/1 R |
| 607,993 | 4/1901 | Matthes | 215/12 R |
| 777,477 | 12/1904 | Lord | 215/1 R |
| 829,477 | 8/1906 | Kruse | 220/72 |
| 3,297,194 | 1/1967 | Schaper | 220/72 |
| 3,331,521 | 7/1967 | Paige | 215/1 R |
| 3,802,595 | 4/1974 | Frahm | 217/52 |

FOREIGN PATENT DOCUMENTS

| | | | |
|---|---|---|---|
| 882528 | 5/1950 | Fed. Rep. of Germany | 220/72 |

OTHER PUBLICATIONS

George Fyre & Wm. Spottiswoode — Printers of Drawing From British Source of 1882.

*Primary Examiner*—Ro E. Hart
*Attorney, Agent, or Firm*—Lyon & Lyon

[57] ABSTRACT

A case for a five gallon water bottle has an internal abutment cooperating with a raised bead on the bottle to prevent inadvertent or accidental removal of the bottle from the case. The bottle for its removal requires its neck portion to be raised manually sufficiently such that such bead may ride over or clear such abutment. Such neck portion is cylindrical and is sufficiently prolonged between raised portions to allow a person to wrap four fingers of his hand around such cylindrical portion for easier and safer handling of the bottle.

1 Claim, 2 Drawing Figures

WATER BOTTLE AND ITS STORAGE CASE

This is a continuation of application Ser. No. 605,462, filed Aug. 18, 1975 now abandoned.

The present invention relates to improvements in the bottled water art.

A specific object of the present invention is to provide an improved water bottle of the five gallon size.

Another specific object of the present invention is to provide an improved bottle-case combination which serves the purpose of preventing or greatly minimizing the inadvertent or accidental removal of the bottle from its case.

The features of the present invention which are believed to be novel are set forth with particularity in the appended claims. This invention itself, both as to its organization and manner of operation, together with further objects and advantages thereof, may be best understood by reference to the following description taken in connection with the accompanying drawings in which:

Figure 1:
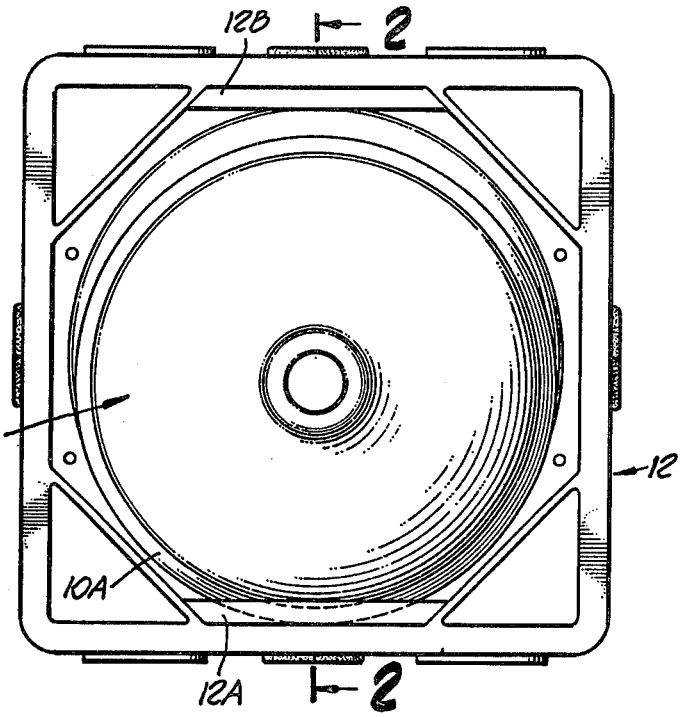
FIG. 1 is a view in side elevation taken generally as indicated by the line 1—1 in FIG. 2.
Figure 2:
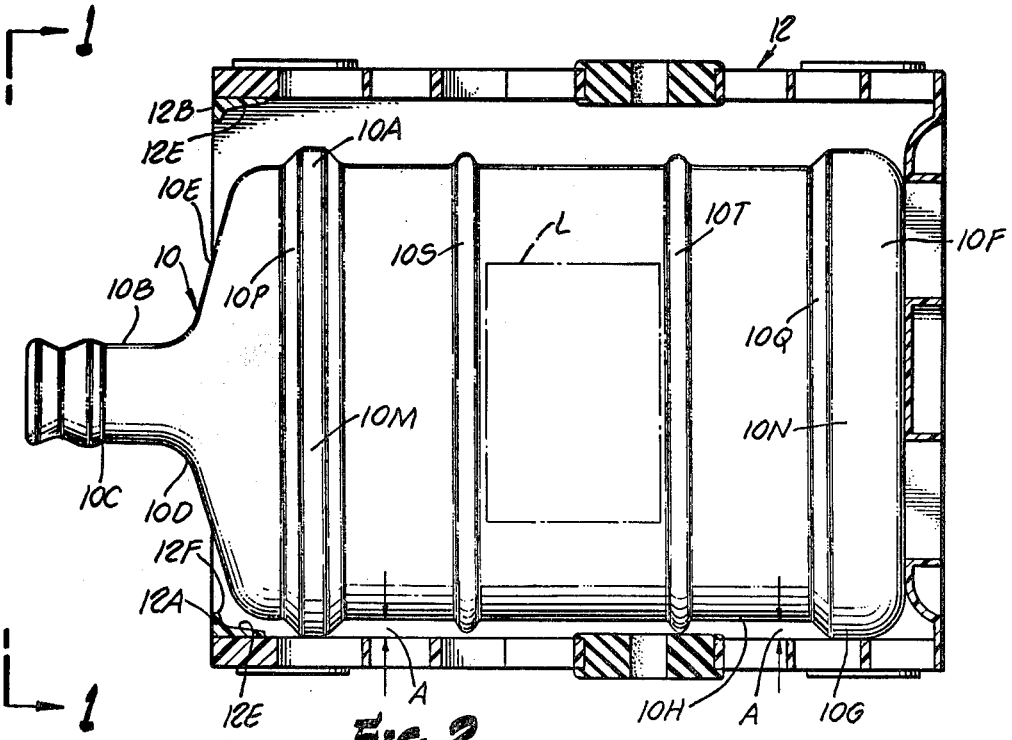
FIG. 2 is generally a sectional view taken as indicated by the lines 2—2 in FIG. 1.

The bottle 10 of five gallon size may be of the form shown herein or in our U.S. Design patent application Ser. No. 494,465, filed Aug. 5, 1974, and now presently allowed in that it is formed with a raised circumferential bead or flange 10A near the top of the bottle such that when such bottle 10 is placed on its side, as shown in FIG. 2, to rest within a case 12 of construction exemplified in our U.S. Pat. No. 3,802,595 issued Apr. 9, 1974, such bead or flange 10A is behind one of a pair of abutments 12A, 12B affixed to and inside of case 12.

One of these abutments 12A, 12B (the abutment 12A in the position of the case 12 in FIG. 2) cooperates with the bead 10A to prevent inadvertent accidental removal of the bottle 10 from its cause during, for example, transport of the bottle 10 in case 12, in handling and also during when in storage during earthquake.

For removal of the bottle 10 from its case 12 it is necessary to manually lift the neck end of the bottle 10 so that such bead 10A is free to move over abutment 12A. For these purposes and also for greater ease in handling of the five gallon bottle filled with water the neck portion 10B is of sufficiently long generally cylindrical construction so that essentially all four fingers of a person's hand can be wrapped around that cylindrical neck portion which extends from the neck flanged portion 10C to the region 10D where such neck portion curves and flares outwardly at what may be referred to as the top of the bottle.

The bottle 10, as shown, is formed with a bulbous bottom portion 10F which is defined in part by another bead or flanged portion 10G of substantially the same outside diameter as the front bead 10A and which extends radially outwardly from the main cylindrical body portion 10H of the bottle substantially the same distance designated as A in FIG. 2. It will be seen that the bead portions 10A, 10G are each in general defined by an outer portion having an outer cylindrical surface 10M, 10N contiguous with a tapered surface 10P, 10Q respectively, such tapered surface 10P, 10Q extending from the corresponding cylindrical portion 10M, 10N to the outer surface of the cylindrical body portion 10H.

The abutments 12A, 12B are preferably of the shape shown and are each defined by an inner tapered portion 12E which tapers inwardly, i.e., is smaller in cross section the further it extends within the case 12 and such tapered portion 12E is contiguous with a raised portion 12F, such raised portion 12F being in the path of outward movement of the bottle (if the neck portion of the bottle is not manually raised to clear such raised portion 12F) to produce the desired result of preventing inadvertent or accidental removal of the bottle 10 from its case 12.

The other two intermediate spaced beads or flanges 10S, 10T of smaller diameter than the bead portion 10M is for increased strength of the bottle of which is preferably of plastic material, such bead portions serving also to some extent to prevent or minimizing damage to or scuffing of a paper label designated L which may be pasted to the bottle for identification and information purposes.

While the particular embodiments of the present invention have been shown and described, it will be obvious to those skilled in the art that changes and modifications may be made without departing from the invention in its broader aspects and, therefore, the aim in the appended claims is to cover all such changes and modifications as fall within the true spirit and scope of this invention.

We claim:

1. In combination a bottle of approximately five gallon capacity, a case for the bottle having an abutment, said bottle having a raised bead engageable with said abutment and over which said bottle is required to be raised for removal of the bottle from said case, said bead and abutment being normally engageable to prevent inadvertent or accidental removal of the bottle from the case, said bead and said abutment having approximately the same height, said bottle having a cylindrical neck portion of sufficient length such that approximately four fingers of a person's hand may encircle the same for raising the bottle above said abutment for removal of said bottle and for convenient handling of the bottle after removal of the bottle from its case, said bead extending circumferentially of the bottle, said bead having an external diameter somewhat less than the spacing between a plurality of abutments on the case each of which is engageable, depending upon the position of said case, with said bead, said bead having an outer cylindrical portion contiguous with an inner tapered portion, said tapered portion being engageable in initial movement of the bottle from said case, with an inner tapered portion of said abutment, said bottle having a bulbous base portion which has an external diameter substantially equal to the external diameter of said raised bead, said bottle including two spaced beads between said bead and said bulbous base portion, said two spaced beads defining a space therebetween for attachment of a label which is protected against scuffing during insertion and removal of the bottle from its case, said spaced beads are of equal external diameter which is less than the external diameter of said bead and said bulbous base portion, said bead and said bulbous base portion being the sole means on said bottle which contacts said case when said bottle is within said case, with said abutment being the sole means which prevents slippage of the bottle out of the case.

* * * * *

UNITED STATES PATENT AND TRADEMARK OFFICE

CERTIFICATE OF CORRECTION

PATENT NO. : 4,143,784

DATED : March 13, 1979

INVENTOR(S) : Carl E. Frahm; Shirley E. Frahm

It is certified that error appears in the above-identified patent and that said Letters Patent are hereby corrected as shown below:

Column 1, line 36 should read: One of these two abutments . . .

Column 1, line 39 should read: of the bottle 10 from its case during, . . .

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*